US006042045A

United States Patent [19]

Hack et al.

[11] Patent Number: 6,042,045

[45] Date of Patent: Mar. 28, 2000

[54] RING SPINNING SPINDLE WITH A YARN CUTTING DEVICE

[75] Inventors: Kurt Hack, Ebersbach/Fils; Peter Mann, Süssen; Alois Gürtler, Oberviechtach, all of Germany

[73] Assignee: Zinser Textilmaschinen GmbH, Ebersbach/Fils, Germany

[21] Appl. No.: 09/176,165

[22] Filed: Oct. 21, 1998

[30] Foreign Application Priority Data

Oct. 22, 1997 [DE] Germany ..... 197 46 536

[51] Int. Cl.[7] ..... B65H 54/71; D01H 9/16

[52] U.S. Cl. ..... 242/487.6; 242/487.9; 57/276; 57/303

[58] Field of Search ..... 242/487.6, 487.9, 242/487.7; 57/129, 130, 276, 277, 278, 303

[56] References Cited

U.S. PATENT DOCUMENTS

| | | | |
|---|---|---|---|
| 3,731,479 | 5/1973 | Flowers et al. | 242/487.7 |
| 3,967,440 | 7/1976 | Narumi et al. | 242/487.7 |
| 4,050,227 | 9/1977 | Berend | 57/303 |
| 4,075,919 | 2/1978 | Komura et al. | 83/676 |
| 4,796,422 | 1/1989 | Odawara | 242/487.6 |
| 5,562,268 | 10/1996 | Bothner | 242/487.7 |

FOREIGN PATENT DOCUMENTS

| | | |
|---|---|---|
| 24 61 623 | 11/1975 | Germany . |
| 32 02 888 | 9/1982 | Germany . |
| 40 15 707 | 11/1991 | Germany . |
| 42 37 475 | 5/1994 | Germany . |
| 43 36 359 | 4/1995 | Germany . |
| 44 44 402 | 6/1996 | Germany . |

OTHER PUBLICATIONS

Sinterstahl, Sintered Metal Rings—Reiners+Fürst leaflet.

*Primary Examiner*—John M. Jillions
*Attorney, Agent, or Firm*—Herbert Dubno

[57] ABSTRACT

A single piece thread cutter for a ring spinning spindle has radially and axially extending lugs spaced apart about the periphery of the cup shaped sheet metal cylindrical or conical body. Where the lugs are formed by bending tabs, they may be doubled up to increase the stability and thickness.

14 Claims, 2 Drawing Sheets

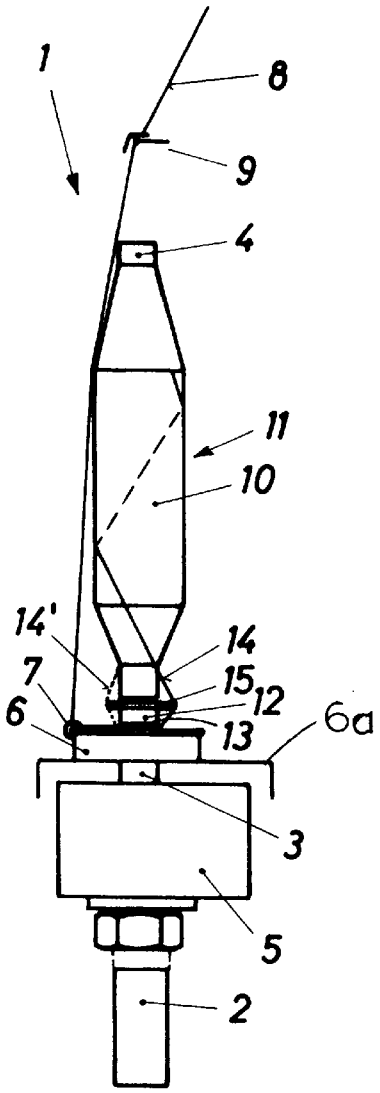
Fig. 1
Fig. 2
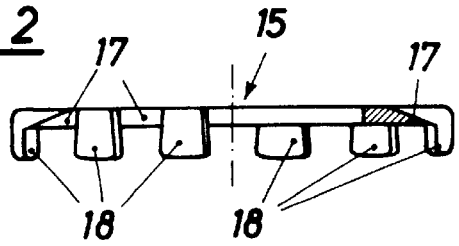
Fig. 3
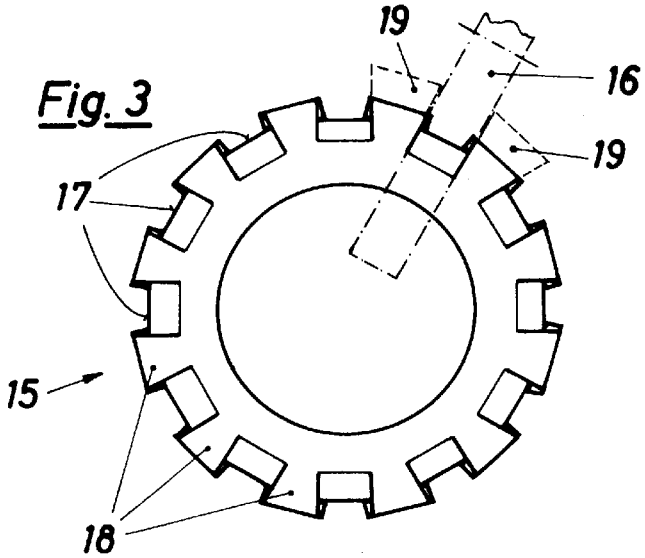
Fig. 4
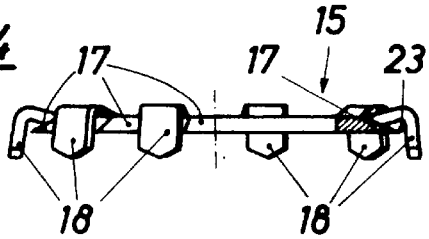
Fig. 5
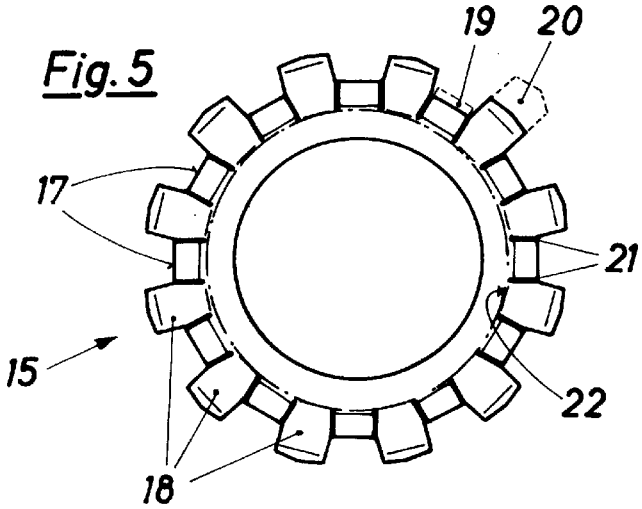

RING SPINNING SPINDLE WITH A YARN CUTTING DEVICE

FIELD OF THE INVENTION

The present invention relates to a ring spinning spindle with a cutting device for severing the spun yarn at the conclusion of a bobbin winding operation in ring spinning machine. More particularly, the invention relates to a cutting device of the type in which a plurality of teeth are provided on a cutting unit, between which blade portions are provided and the yarn is drawn against the blade unit when the yarn is to be severed for removing a full bobbin from the machine. The teeth serve to limit the sliding of the yarn relative to the cutting device about the periphery thereof and to prevent injury from sharp edges thereof.

BACKGROUND OF THE INVENTION

Separating or cutting units for severing a yarn of a fully wound bobbin in a ring spinning machine are described in the patent literature. A ring spinning bobbin, it will be understood, is usually a bobbin built upon a core or sleeve which is mounted on a spindle. The roving may be drawn from roving bobbins through drafting frames of the ring spinning machine and pass through a thread-guide eye above the spindle and then through a traveller orbiting the spindle on a traveller ring. The traveller ring can be raised and lowered with respect to the bobbin on a ring rail while the spindle is provided on a spindle rail which generally also can be raised or lowered, e.g. for the bobbin change operation. The spindle can be provided on the spindle rail with a whorl tangentially engaged by a belt for driving the spindle and below the sleeve on the spindle a thread reserve can be collected to hold the yarn preparatory to severing it for bobbin removal or preparatory to the winding of the yarn on a freshly positioned core or sleeve. Generally above this reserve, a cutting device can be provided for the purposes described. Mention may be made, for example, of German Patent Document DE 42 37 475 A1 and German Patent Document DE 40 15 707 C2. The cutting system described in these references have the tooth arrangement and the blade arrangement formed on two separate parts which can be injection molded or pressed or stamped elements. Of course this means that two A separate parts for each spindle or station of each ring spinning machine must be provided and assembled together and mounted on the spindle. When it is recognized that ring spinning machines may have very large numbers of such spindles and stations, it will be apparent that the cost of such systems is substantial. Furthermore, since the blades constitute wear parts, they must be replaced and the replacement cost, even through occasional, can be considerable as well. Mention may also be made of the fact that when the toothed member and the blade member are fabricated separately and assembled together, spaces inevitably are formed in which the thread or yarn can catch. These may have to be manually cleared.

Reference may also be had to German Patent Document DE 43 36 359.8 (see also U.S. Pat. No. 5,562,268) which provides still another type of cutting blade which has the advantage of being fabricated more inexpensively than more complex blades but which nevertheless must be used together with a toothed member if it is to be fully effective. German Patent Document DE 32 02 888 A1 describes a ring spinning machine with a device for automatically removing the bobbins and, in conjunction therewith, cutting the thread and located above the thread reserve portion on the spindle. Here the blade itself is notched but no separate toothed member is provided nor are there toothed 156 formations which serve to protect against injury by contact with the cutting edges. Finally, mention may be made of the German Patent Document 24 61 623 C2 which also discloses a notched blade which is not used in conjunction with protective teeth or like members.

OBJECTS OF THE INVENTION

It is the principal object of the present invention, therefore, to provide an improved but simplified cutting arrangement for a ring spinning spindle which retains advantages of the prior art arrangements described without the drawbacks thereof.

More particularly, it is the object of the invention to provide a ring spinning spindle and yarn cutting device therefore which can be fabricated more economically than earlier devices, affords protection against injury, limits the sliding of the yarn along the cutting unit and avoids crevices and the like in which the yarn or yarn fragments can latch and which then require clearing by hand.

Still another object of this invention is to provide an improved cutting device for the purpose described which is free from the drawbacks of earlier cutting devices on ring spinning spindles.

SUMMARY OF THE INVENTION

These objects are attained, in accordance with the invention in a ring spinning spindle with a cutting device for severing the yarn to be spun from the full bobbin and which comprises cutting edges and teeth, the latter forming cams or lugs which are capable of deflecting the fingers of the operator away from the cutting edges, the lugs projecting radially beyond the blades along segments of a disk and also extending somewhat in the axial direction. According to the invention, the cutting device is a one-piece sheet metal member drawn into a cup shape and formed at its periphery with blunt edged lugs and sharp edged blade portions between them and set radially back from the outermost portions of these teeth or lugs.

According to the invention, the cup shaped member has a slightly conical shape or is cylindrical, i.e. has the configuration of a surface of revolution centered on the spindle axis and preferably widening downwardly in the case of a somewhat conical configuration. The base of the cup can be a flat disk and, because of the one-piece construction is, of course, unitary with the lugs and the cutting edges.

Because the separating device in the invention is a cylindrical or slightly conical, otherwise flat, cup shaped member, its periphery can be formed with radially projecting and axially extending blunt edged lugs and sharp edged blade portions set back therefrom. When these lugs lie along a cylindrical or slightly conical surface, the entire separating or cutting device can be formed from a single inexpensive sheet metal part which is economically fabricated by a low cost process like stamping, drawing, embossing, shaping or the like. Only one piece need be handled and assembly with other pieces to form the cutting unit is not required.

Since the sheet metal part extends along the axis to a certain extent, the cutting blades need not lie exclusively in the plane of the base of the cup and can partly extend, if desired, into the cylindrical or conical wall, i.e. in the direction of the axis of the ring spinning spindle. Also, because the entire unit is formed in one piece there are no crevices as is found in multipartite cutting units in which thread fragments can catch and which create problems in operation and must be removed.

According to a feature of the invention, the cutting member is formed by stamping, preferably from a planar sheet metal part and the cutting edges are formed by grinding, stamping or embossing. The radial teeth between the cutting edges are thus drawn so that they extend along the axis and thus form the lugs. These lugs can have any desired contour, e.g. they can be rounded, and the cutting edges between these lugs can lie in the plane of the disk. However, the cutting edges can also be drawn to lie along the cylindrical or slightly conical portion of the member. The radial teeth can be bent over themselves so as to be of double thickness in forming the lugs.

By appropriate stamping techniques, the tabs which form the teeth or lugs, can have any shape and depending upon the processing, for example, grinding or cutting or bending or drawing, the lugs can have a variety of configurations and the cutting edges can be formed on such tabs as well.

It has been found to be advantageous to have the lugs inclined outwardly from the axis of the spindle toward the free ends of the lugs and to thereby space the inner surfaces of the lugs from the cutting edges which can lie along a cylinder entered on the axis.

Threads or thread fragments which might otherwise collect in the crevices can be easily drawn off but cleaning is usually unnecessary since such fragments are generally thrown off automatically by the centrifugal force as the cutter and spindle spin. Any desired contour of the lugs as cutting edges can be achieved during the stamping, punching or drawing or in a subsequent grinding.

Cutting units which are fabricated according to the invention from very thin steel sheet have the advantage that little force or time is required for sharpening the cutting edges and a minimum of removal is necessary. Even such cutting devices, however, will usually have sufficient strength and stiffness, especially when the lugs are formed by doubling over of the tab and hence doubling of the lug thickness.

According to another feature of the invention, both the cutting edges and the lugs lie on a continuous apron from the disk and having a conical or cylindrical shape. The result is a configuration not unlike a crown-type bottle cap with the lugs forming the projecting portions and the cutting edges being formed on the set back portions. The set back portions can be sharpened by shaving two cutting edges. The cutting device in this embodiment has no undercuts beneath which thread fragments can be captured such a cutting device can also be deburred and rounded by tumbling with abrasive bodies. In such tumbling, the set back cutting edges are not dulled.

In still another embodiment of the invention, the cutting device can be fabricated without removal of material in a single shaping step in a negative mold. The techniques used for this purpose can include power metal sintering (powder metallurgy), die casting or injection techniques. It has been found that with these processes edges of the requisite sharpness and hardness can be generated. The cutting part according to the invention has the advantage that it is fabricated in a single step. However it is also possible to subject the cutting edges to additional sharpening by, for example, a galvanic after-treatment.

The most important parts of the cutting member of the invention are, of course, the cutting edges and the lugs formed in one piece. When the cutting device must have other components for example, lugs to enable them to snap into the upper part of the spindle or to otherwise engage the spindle, guide sleeve for accurate positioning of the cutter and the like, it will be self understood that these further components can also be formed during the drawing of the cutter in the manner described.

BRIEF DESCRIPTION OF THE DRAWING

The above and other objects, features, and advantages will become more readily apparent from the following description, reference being made to the accompanying drawing in which:

FIG. 1 is a diagrammatic elevational view of a ring-spinning spindle with a thread or yarn separating device according to the invention FIG. 2 is an elevational view, partly broken away of a cutting member of such a device;

FIG. 3 is a plan view of the cutter of FIG. 2;

FIGS. 4 and 5 are views similar to FIGS. 2 and 3 illustrating another embodiment;

SPECIFIC DESCRIPTION

Figure 6:
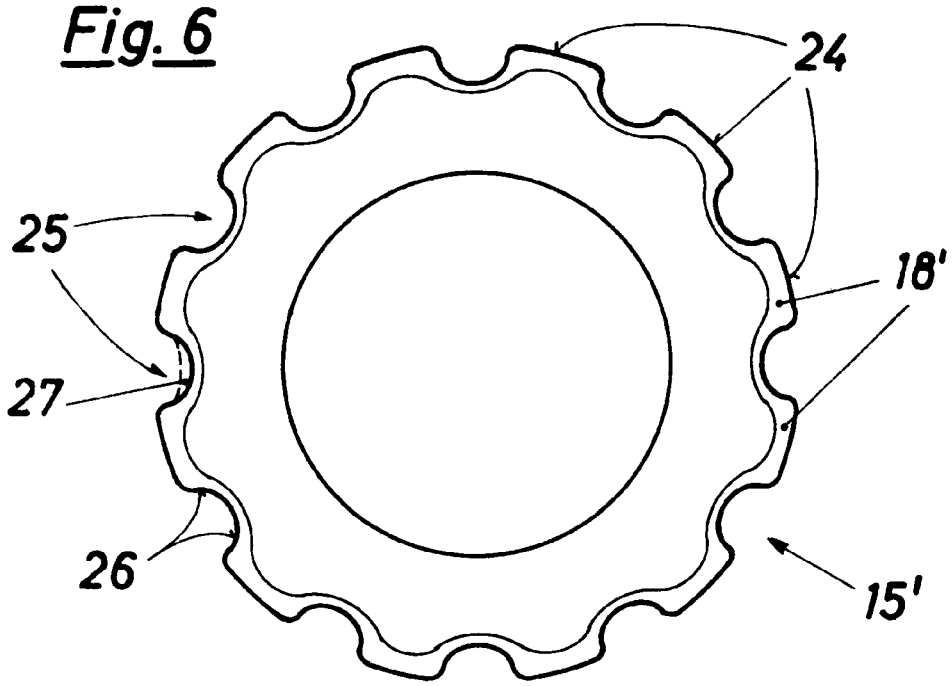
FIGS. 6 and 7 are views similar to FIGS. 3 and 2. respectively of a third embodiment.

FIG. 1 shows a standard ring-spinning spindle represented at 1 and which has a spindle upper part 3 projecting from the spindle rail 5 from which the lower part 2 of the spindle projects downwardly. The spindle carries a core or sleeve 4 on which a bobbin may be wound as represented at 10. In the spindle rail 5 a whorl of the spindle may be tangentially engaged by a drive belt as is common in such ring spinning machines.

The thread or yarn is distributed to the bobbin by a spinning ring 6 upon which a traveller 7 orbits to reserve the thread 8 from a drafting frame, which has not been illustrated, via a thread guide eye 9. The ring rail is seen at 6a and the bobbin including the winding 10 and the core 4 has been represented at 11.

In FIG. 1 the ring spinning spindle has been shown in a position in which the winding of the bobbin 11 has been completed and a portion of the oncoming thread 8 has been wound in a reserve or underwinding region 12 of the upper part 3 of the bobbin. The winding here has been represented at 13.

The thread 14 must be cut if the bobbin is to be removed. To facilitate this and prevent a drawing of the thread from the reserve 13, between the reserve region 12 and the bobbin 11, on the upper part 3 of the bobbin a cutting device 15 is provided which intercepts the thread 14 and upon removal of the bobbin will cut it.

When the spinning process is to be repeated after bobbin change, i.e. after removal of the full bobbin and the replacement of an empty core sleeve 4 and the replacement on the spindle a starting thread 14' is withdrawn from the reserve 13 as shown in broken lines at 14' so that the winding of a new bobbin can commence. This thread 14' is usually pulled out by a unit which during the spinning process removes the remainder of the thread reserves from below the cutter 15. When this does not occur or occurs somehow incorrectly, even this starting thread 14' is cut by the removal of the bobbin.

Previous cutting blades had uninterrupted cutting edges on their outer peripheries and cooperated with lugs on separate covering disks which were intended to prevent injury by inadvertent contact of an individual with the upper part 3 of the spindle and which serve to limit the sliding of the thread 14' along the periphery of the cutting blade during removal of the bobbin 11.

The cutter 15 in the embodiment of FIGS. 2 and 3 is formed from a planar steel disk which is ground along its outer periphery to form sharp cutting edges 17 by a disk shaped. grinding wheel 16 (FIG. 3). Between the ground edges, tabs 19 remain. Two such tabs have been shown in broken lines in FIG. 3. The tabs 19 are then bent to lie along the axis in a deep drawing operation, thereby forming the lugs 18 which project radially beyond the cut edges 17 and also extend along the axis of the spindle 1. They thus provide protection against contact with the cutting edges along with guides to be cut.

From FIG. 3 it will be apparent that 12 cutting edges 17 can be provided in conjunction with 12 lugs 18. The number of cutting edges and the number of lugs and the widths of the cutting edges and the lugs can, of course, be different from those shown. FIGS. 4 and 5 show an embodiment in which the outer periphery of the steel disk from which the cutting device 15 is formed can be provided by stamping with alternating tabs 19 and 20 which are respectively radially short and radially long as measured from the imaginary circle shown in dot-dash lines 22 at which the flaps 20 can be bent downwardly to form the lugs 18. The tabs 19 can be ground to form the sharp cutting edges 17 seen in FIG. 4. With the two tabs 19 and 20, spaces 21 are provided. The contours of the lugs 18 which are bent upwardly and downwardly as can be seen in FIG. 4, can be imparted to the cutting device by the stamping dies.

It will also be apparent from FIG. 4 that between the inner surface of the lugs 18 and the cutting edges 17, a short distance 23 is maintained so that thread fragments which are captured between the lugs and the cutting edges are not clamped in the device.

When the lugs 18 are inclined outwardly and downwardly away from the axis 1, when the cutting device rotates with the spindle, centrifugal force will cast out any thread residues which might become trapped.

Preferably the overall shape of the cutter is cup-shaped which has been illustrated in FIGS. 2–5 with a cylindrical or slightly conical configuration. The tabs 19 and 20 are bent accordingly.

Figure 7:
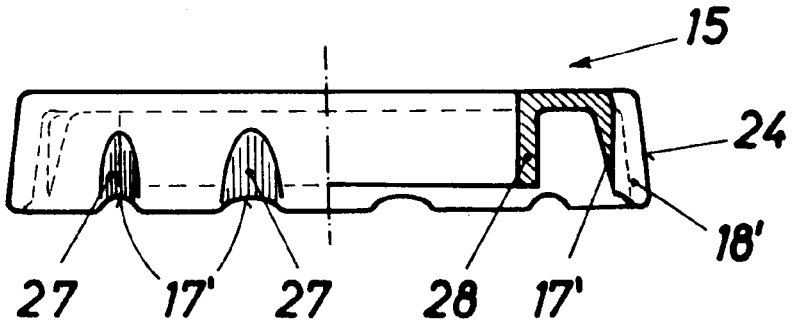

FIGS. 6 and 7 show another embodiment which also can be formed by stamping or drawing and in which the cutter 15' has a bottle cap shape with projecting portions or lugs 24 and recessed portions 25 forming the cutting edges 17'. The latter are formed by a shaving operation. The lugs 18' formed by the projections 24 again prevent contact with the cutting edges. The recesses 25 have lateral flanks 26 which lie approximately radial with respect to the spindle axis. The shaved away part forming the cutting edges 17' have been shown at 27.

Figure 8:
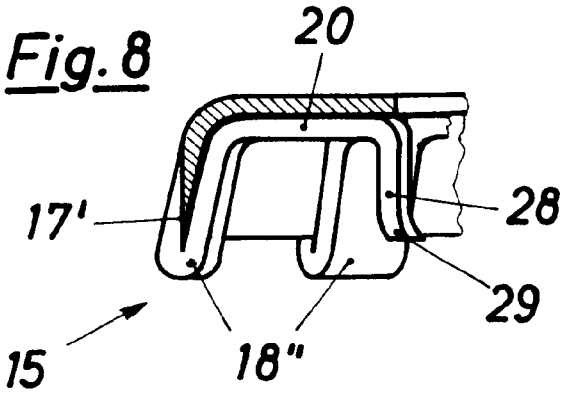
FIGS. 8 and 9 are fragmentary cross sectional views illustrating features of two other embodiments of the cutter.

In order to keep the grinding work required for the blades of FIGS. 2–5 as small as possible, the thinnest possible sheet metal is used for the cutter 15. To ensure sufficient stability of the thin cutter, as has been shown in FIG. 8, the tabs 20 can be folded back along the underside of the cutter to double the thickness thereof. The bending can be effected by a deep drawing process and yields the lugs 18" shown in FIG. 8. The doubled up lugs can be further stiffened by soldering them or cementing them in place. In the embodiment of FIG. 8, the cutting edges and those of FIGS. 6 and 7 can be ground by a tool which can be raised and lowered.

Figure 9:
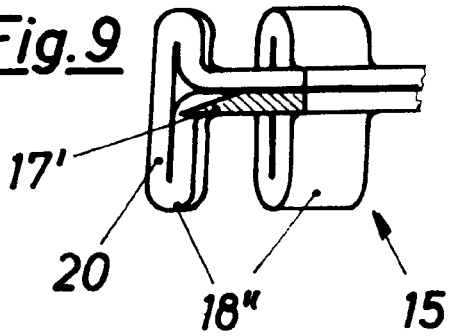

In the embodiment of FIG. 9, the lugs 18" are formed by multiple folds of the tabs 20. FIGS. 8 and 9 thus demonstrate that the lugs can have a variety of configurations and can lie along a conical surface or a cylindrical surface.

The cutters of FIGS. 6 and 8 can be provided with a shoulder along its inner periphery enabling the cutter to be mounted precisely on the upper part of the spindle. This shoulder 28 can be formed during the deep drawing of the cutter. As has been shown for the embodiment of FIG. 8, the shoulder 28 can have a nose or projection 29 which engages in a groove in the spindle upper part there to lock the cutter to the spindle.

A cutting device of the type illustrated in FIGS. 6 or 7 can also be fabricated by a machining free process, i.e. by shaping the part in a die or mold which is negative of the part to be fabricated. For this purpose we can use die casting or a metal injection process or can produce the cutter by sintering from powder metal. In such cases only a single processing step is required and it is not necessary to after-treat the product. However, it has been found to be advantageous to sharpen the cutting edges 17 and 17' and preferably by a galvanic process.

We claim:

1. A ring-spinning spindle having a thread cutter for cutting a spun thread from an oncoming thread, said thread cutter comprising a cup-shaped one-piece sheet metal member having distributed along an outer periphery thereof a multiplicity of radially and axially extending angularly spaced blunt-edged lugs and inwardly of said lugs sharp cutting edges between said lugs.

2. The ring-spinning spindle defined in claim 1 wherein said cutting edges are formed at angularly equispaced locations in an outer edge of a circular sheet metal disk formed with radial teeth and said teeth are bent to extend axially between said cutting edges to form said lugs.

3. The ring-spinning spindle defined in claim 1 wherein said cutting edges are formed at angularly equispaced locations in an outer edge of a circular sheet metal disk with alternating tabs adapted to be bent in a direction of a spindle axis to form said cutting edges and said lugs, respectively, the tabs forming said cutting edges being sharpened and the tabs forming said lugs projecting outwardly beyond the tabs forming said cutting edges.

4. The ring-spinning spindle defined in claim 1 wherein said lugs are folded-over tabs formed on said disk to double the thickness of said lugs.

5. The ring-spinning spindle defined in claim 1 wherein a spacing is provided between inner surfaces of said lugs and the cutting edges.

6. The ring-spinning spindle defined in claim 1 wherein said lugs form obtuse angles with said disk and diverge from said axis toward free ends of said lugs.

7. The ring-spinning spindle defined in claim 1 wherein said thread cutter is of generally cylindrical or slightly conical form having an annular apron with said lugs projecting radially beyond said cutting edges set inwardly from said lugs.

8. The ring-spinning spindle defined in claim 1 wherein said cutting edges are sharpened.

9. The ring-spinning spindle defined in claim 8 wherein the sharpening of said cutting edges is effected in a galvanic process.

10. A ring-spinning spindle having a thread cutter for cutting a spun thread from an oncoming thread, said thread cutter comprising a cup shaped one-piece sheet metal member fabricated without removal of material in a shaping operation forming a multiplicity of radially and axially extending angularly spaced blunt edged lugs and inwardly of said lugs, sharp cutting edges located between said lugs.

11. The ring-spinning spindle defined in claim 10 wherein said thread cutter is formed by a powder metal sintering operation.

12. The ring-spinning spindle defined in claim 10 wherein said thread cutter is formed in a die casting or injection operation.

13. The ring-spinning spindle defined in claim 12 wherein said cutting edges are sharpened.

14. The ring-spinning spindle defined in claim 13 wherein the sharpening of said cutting edges is effected in a galvanic process.

* * * * *